US006945524B2

(12) United States Patent
Meier et al.

(10) Patent No.: US 6,945,524 B2
(45) Date of Patent: Sep. 20, 2005

(54) CARD SINGULARIZATION GATE

(75) Inventors: James R. Meier, St. Paul, MN (US); Martin A. Pribula, Eden Prairie, MN (US); Stacy W. Lukaskawcez, Shakopee, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 228 days.

(21) Appl. No.: 10/235,340

(22) Filed: Sep. 5, 2002

(65) Prior Publication Data

US 2004/0046307 A1 Mar. 11, 2004

(51) Int. Cl.[7] ..... B65H 5/00

(52) U.S. Cl. ..... 271/10.01; 271/10.09; 271/124

(58) Field of Search ..... 271/10.01, 10.09, 271/10.11, 121, 124, 125, 137, 138, 167; 414/797.4, 797

(56) References Cited

U.S. PATENT DOCUMENTS

| | | | | |
|---|---|---|---|---|
| 1,515,986 A | * | 11/1924 | Merrick et al. | 271/125 |
| 2,867,437 A | | 1/1959 | Davy | 271/44 |
| 2,937,019 A | | 5/1960 | Rose | 271/44 |

(Continued)

FOREIGN PATENT DOCUMENTS

| | | |
|---|---|---|
| DE | 25 35 699 A1 | 3/1977 |
| EP | 0 115 208 | 12/1983 |
| EP | 0 562 979 | 9/1993 |
| EP | 0 887 197 | 12/1998 |
| EP | 0 979 736 | 2/2000 |
| EP | O 992 347 A2 | 4/2000 |
| EP | 0 995 603 A2 | 4/2000 |
| FR | 1068162 | 12/1952 |
| GB | 1 237 145 | 8/1968 |
| GB | 2 120 821 A | 12/1983 |
| JP | 10337886 | 12/1998 |
| JP | 11 265463 | 9/1999 |
| WO | WO 95/09084 | 4/1995 |
| WO | WO 98/51507 | 11/1998 |
| WO | WO 99/04368 | 1/1999 |
| WO | WO 99/21713 | 5/1999 |
| WO | 99/49379 | 9/1999 |
| WO | WO 01/92019 A2 | 12/2001 |
| WO | WO 03/089348 A1 | 10/2003 |

OTHER PUBLICATIONS

"Standard Read/Write Identification IC", by TEMIC Semiconductor GmbH, Heilbronn, Germany, (Apr. 1999).

"Introducing the New SmartGuard™ and SmartShield™ Advanced Security Options", pamphlet by Fargo Electronics, Inc., Eden Prairie, Minnesota (1998).

(Continued)

*Primary Examiner*—David H. Bollinger
(74) *Attorney, Agent, or Firm*—Westman, Champlin & Kelly

(57) ABSTRACT

A card singularization gate for use in an identification card printer includes a roller support, a guide roller, and a card stop. The roller support is positioned between a card feeder and the card transport mechanism. The guide roller is supported by the roller support for rotation about an axis that is substantially parallel to a card feed plane and transverse to a card path. The guide roller includes a card engaging side adjacent the card feed plane where non-abrasive contact of a first surface of the lead card is made during the card feed operation. The card stop is positioned adjacent a side of the guide roller that is opposite the card engaging side. During card feed operations, the lead card is allowed passage to the card transport mechanism along the card engaging side of the guide roller while cards that are stacked upon the lead card are blocked by the card stop.

25 Claims, 7 Drawing Sheets

U.S. PATENT DOCUMENTS

| | | | | | |
|---|---|---|---|---|---|
| 3,290,042 | A | | 12/1966 | Johnson et al. | 271/44 |
| 3,598,396 | A | | 8/1971 | Andrews et al. | 271/9 |
| 3,889,472 | A | | 6/1975 | Guillaud | 60/698 |
| 3,908,983 | A | | 9/1975 | Long | 271/35 |
| 3,960,072 | A | | 6/1976 | Ahlgren et al. | 101/35 |
| 3,991,998 | A | * | 11/1976 | Banz et al. | 271/125 |
| 4,015,839 | A | | 4/1977 | McKee | 271/37 |
| 4,017,068 | A | | 4/1977 | McKee | 271/275 |
| 4,031,578 | A | | 6/1977 | Sweeney et al. | 340/172.5 |
| 4,068,028 | A | | 1/1978 | Samonides | 428/40 |
| 4,102,267 | A | | 7/1978 | Ritzerfeld | 101/132.5 |
| 4,146,900 | A | | 3/1979 | Arnold | 346/75 |
| 4,161,312 | A | | 7/1979 | Eckhardt et al. | 271/3 |
| 4,393,386 | A | | 7/1983 | Di Giulio | 346/75 |
| 4,437,658 | A | * | 3/1984 | Olson | 271/125 |
| 4,534,313 | A | | 8/1985 | Louvel | 118/696 |
| 4,604,631 | A | | 8/1986 | Jinnai et al. | 346/1.1 |
| 4,680,596 | A | | 7/1987 | Logan | 346/140 |
| 4,685,702 | A | | 8/1987 | Kazuharu | 283/81 |
| 4,686,540 | A | | 8/1987 | Leslie et al. | 346/33 |
| 4,716,346 | A | | 12/1987 | Matsuo | 318/38 |
| 4,734,868 | A | | 3/1988 | DeLacy | 364/519 |
| 4,781,985 | A | | 11/1988 | Desjarlais | 428/421 |
| 4,797,018 | A | | 1/1989 | Hofmann et al. | 400/208 |
| 4,845,490 | A | | 7/1989 | Ward et al. | 340/825.31 |
| 4,961,088 | A | | 10/1990 | Gilliland et al. | 355/206 |
| 4,961,566 | A | * | 10/1990 | Labombarde | 271/35 |
| 5,082,268 | A | | 1/1992 | Santoro | 271/14 |
| 5,111,239 | A | | 5/1992 | Kamimura et al. | 355/45 |
| 5,138,344 | A | | 8/1992 | Ujita | 400/175 |
| 5,149,211 | A | | 9/1992 | Pettigrew | 400/88 |
| 5,184,181 | A | | 2/1993 | Kurando et al. | 355/260 |
| 5,239,926 | A | | 8/1993 | Nubson et al. | 101/487 |
| 5,244,197 | A | * | 9/1993 | Helmstadter | 271/35 |
| 5,266,968 | A | | 11/1993 | Stephenson | 400/208 |
| 5,267,800 | A | | 12/1993 | Petteruti et al. | 400/88 |
| 5,277,501 | A | | 1/1994 | Tanaka et al. | 400/120 |
| 5,299,796 | A | | 4/1994 | Wooldridge | 271/9 |
| 5,318,370 | A | | 6/1994 | Nehowig | 400/207 |
| 5,327,201 | A | | 7/1994 | Coleman et al. | 355/278 |
| 5,368,677 | A | | 11/1994 | Ueda et al. | 156/362 |
| 5,455,617 | A | | 10/1995 | Stephenson et al. | 400/207 |
| 5,466,319 | A | | 11/1995 | Zager et al. | 156/220 |
| 5,502,464 | A | | 3/1996 | Takahashi et al. | 346/25 |
| 5,516,218 | A | | 5/1996 | Amano et al. | 400/535 |
| 5,545,882 | A | * | 8/1996 | Tanaka | 235/98 R |
| 5,642,877 | A | * | 7/1997 | Green | 271/35 |
| 5,646,388 | A | | 7/1997 | D'Entremont et al. | 235/380 |
| 5,695,589 | A | | 12/1997 | German et al. | 156/250 |
| 5,703,347 | A | | 12/1997 | Reddersen et al. | 235/472 |
| 5,707,162 | A | | 1/1998 | Kasal et al. | 400/692 |
| 5,709,484 | A | | 1/1998 | Dorner | 400/188 |
| 5,755,519 | A | | 5/1998 | Klinefelter | 400/249 |
| 5,837,991 | A | | 11/1998 | LaManna et al. | 235/475 |
| 5,936,008 | A | | 8/1999 | Jones et al. | 523/161 |
| 5,980,011 | A | | 11/1999 | Cummins et al. | 347/4 |
| 5,995,774 | A | | 11/1999 | Applegate et al. | 399/27 |
| 6,011,741 | A | | 1/2000 | Wallace et al. | 365/221 |
| 6,037,879 | A | | 3/2000 | Tuttle | 340/825.54 |
| 6,039,430 | A | | 3/2000 | Helterline et al. | 347/19 |
| 6,071,024 | A | | 6/2000 | Chi-Ming et al. | 347/177 |
| 6,072,402 | A | | 6/2000 | Kniffin et al. | 340/825 |
| 6,099,101 | A | | 8/2000 | Maurelli et al. | 347/7 |
| 6,099,178 | A | | 8/2000 | Spurr et al. | 400/207 |
| 6,102,388 | A | * | 8/2000 | Thornhill | 271/119 |
| 6,113,208 | A | | 9/2000 | Benjamin et al. | 347/7 |
| 6,163,658 | A | | 12/2000 | Suzuki | 399/12 |
| 6,193,230 | B1 | | 2/2001 | Tung-Ying | 271/124 |
| 6,213,392 | B1 | | 4/2001 | Zuppicich | 235/380 |
| 6,252,791 | B1 | | 6/2001 | Wallace et al. | 365/221 |
| 6,263,170 | B1 | | 7/2001 | Bortnem | 399/13 |
| 6,264,296 | B1 | | 7/2001 | Klinefelter et al. | 347/4 |
| 6,264,301 | B1 | | 7/2001 | Helterline et al. | 347/19 |
| 6,267,370 | B1 | | 7/2001 | Ito et al. | 271/138 |
| 6,267,463 | B1 | | 7/2001 | Paulsen | 347/19 |
| 6,271,928 | B1 | | 8/2001 | Bullock et al. | 358/1.16 |
| 6,302,527 | B1 | | 10/2001 | Walker | 347/50 |
| 6,305,795 | B2 | | 10/2001 | Childers et al. | 347/86 |
| 6,312,083 | B1 | | 11/2001 | Moore | 347/19 |
| 6,312,106 | B1 | | 11/2001 | Walker | 347/50 |
| 6,325,495 | B1 | | 12/2001 | Foth | 347/84 |
| 6,371,586 | B1 | | 4/2002 | Saruta | 347/7 |
| 6,402,135 | B1 | | 6/2002 | Werner | 271/35 |
| 6,412,770 | B1 | * | 7/2002 | Demmeler | 271/94 |
| 6,485,012 | B1 | * | 11/2002 | Bakoledis | 271/35 |

OTHER PUBLICATIONS

"RFID Tagging IC is First to Accept Input from Sensors", by Microchip Technology Inc., (undated).

Two page web site advertisement from SEIKO Precision, entitled "The lastest design for your CD–R", re: CD Printer 2000.

Two page web site advertisement from SEIKO Precision, entitled "CD Printer 2000".

Two page web site advertisement from SEIKO Precision, entitled "CD Printer 4000".

Partial International Search for International Application No. PCT/US 01/17146, filed May 25, 2001 (with Invitation to Pay Fees).

International Search Report for International Application No. PCT/US 00/01697, filing date Jan. 21, 2000, dated Oct. 18, 2000.

International Search Report for International Application No. PCT/US 03/26654 filed Apr. 25, 2003. Date of mailing Dec. 30, 2003.

* cited by examiner

CARD SINGULARIZATION GATE

BACKGROUND OF THE INVENTION

The present invention relates to a card singularization gate for an identification card printer that provides non-abrasive contact with a surface of the lead card being fed while preventing multiple card feeds.

Identification card printers are generally adapted to print images onto surfaces of cards using a print mechanism. A supply of the cards (card stack) is typically stored in a hopper adjacent a card feeder. The card feeder is configured to feed a lead card of the card stack to a card transport mechanism, which presents the lead card to the print mechanism for printing. The print mechanism can be thermal or ink jet based. Thermal based print mechanisms include a thermal printhead that is adapted to heat a thermal print ribbon to cause dye to transfer from the ribbon to the surface of the card. Ink jet based print mechanisms include an ink jet printhead that receives a supply of ink that is applied to a special ink-receiving surface of the card. The ink-receiving surface, such as one formed of Teslin®, is generally delicate and can be damaged by abrasive contact resulting in poor ink reception and reduced printing quality.

One common problem that is encountered by identification card printers are misfeeds that occur when cards stick together during card feed operations. Such card misfeeds typically jam the card transport mechanism and render the printer inoperable to a user of the system until the jammed cards are removed. Such card misfeeds result in card waste, and reduce printing efficiency. To reduce the likelihood of card misfeeds, identification card printers are typically equipped with a card singularization gate between the card feeder and the card transport mechanism.

Conventional card singularization gates include a rigid plate that is positioned relative to a card feed plane to provide an outlet opening through which the lead card can pass while blocking any cards stacked thereon. However, the positioning of the plate is critical. For example, if the outlet opening is too large, double feeds of thin cards can occur. Similarly, if the outlet opening is too small, non-feeds of thick cards can occur. Card misfeeds can still occur even when the outlet opening is set slightly larger than the thickness of the lead card when, for example, the lead card is warped. As a result, frequent adjustment to the position of the plate relative to the card feed plane is often required.

These problems associated with card singularization gates that utilize rigid plates can be remedied by substituting the rigid plate with a flexible blade that is positioned such that the height of the outlet opening between a bottom edge of the flexible blade and the card feed plane is slightly less than a thickness of the lead card. During card feed operations, the flexible blade flexes in response to the lead card to allow the lead card to pass to the card transport mechanism while cards stacked upon the lead card are blocked by the flexible blade. This flexing of the blade allows the card singularization gate to accommodate cards of varying thickness as well as warped cards without adjustment.

Unfortunately, both the flexible blade and the rigid plate type card singularization gates can engage the lead card in an abrasive manner. Such abrasive contact can damage the delicate ink-receiving surface of the cards used in ink jet based identification card printers.

Accordingly, there exists a need for a card singularization gate for use in an identification card printer that reduces the likelihood of card misfeeds while providing non-abrasive contact with a surface of a lead card being fed on which an image is to be printed.

SUMMARY OF THE INVENTION

The present invention is directed to a card singularization gate for use in an identification card printer to singularize card feed operations. The card feed operations are performed by a card feeder, which drives a lead card of a card stack along a card path defined by a card feed plane toward a card transport mechanism. The card transport mechanism then delivers the lead card to a print mechanism for printing on a first surface of the lead card. The card singularization gate of the present invention further provides this card singularizing function while non-abrasively engaging the first surface of the lead card. The card singularization gate generally includes a roller support, a guide roller, and a card stop. The roller support is positioned between the card feeder and the card transport mechanism. The guide roller is supported by the roller support for rotation about an axis that is substantially parallel to the card feed plane and transverse to the card path. The guide roller includes a card engaging side adjacent the card feed plane where non-abrasive contact of the first surface of the lead card is made during the card feed operation. The card stop is positioned adjacent a side of the guide roller that is opposite the card engaging side. During card feed operations, the lead card is allowed passage to the card transport mechanism along the card engaging side of the guide roller while cards that are stacked upon the lead card are blocked by the card stop. The present invention is further directed to an identification card printer that includes the above-described card singularization gate.

Other features and benefits that characterize embodiments of the present invention will be apparent upon reading the following detailed description and review of the associated drawings.

DETAILED DESCRIPTION OF THE PREFERRED EMBODIMENTS

Figure 1:
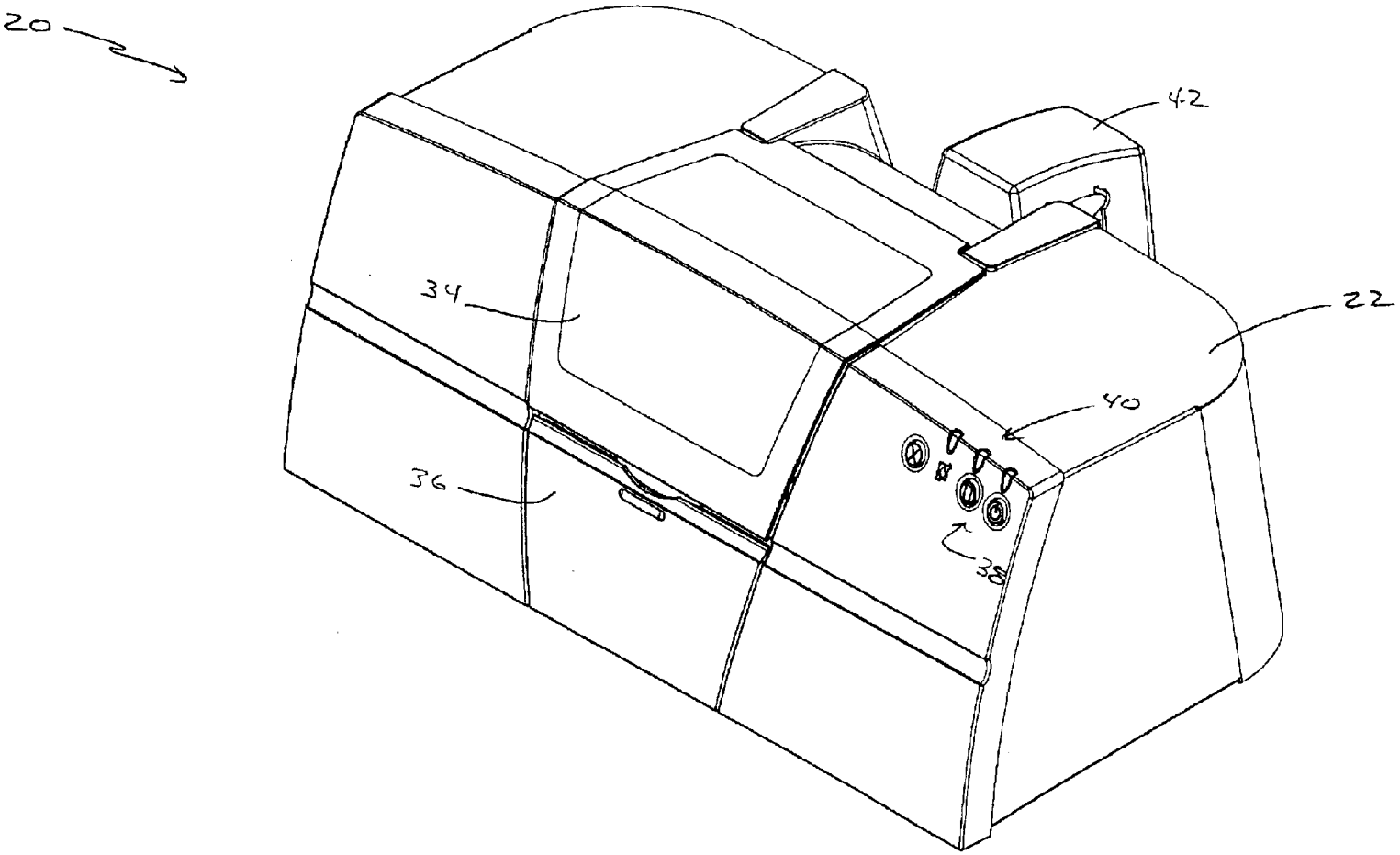
FIGS. 1 and 2 are perspective views of examples of an identification card printer respectively with and without a cover, in accordance with embodiments of the invention.
Figure 2:
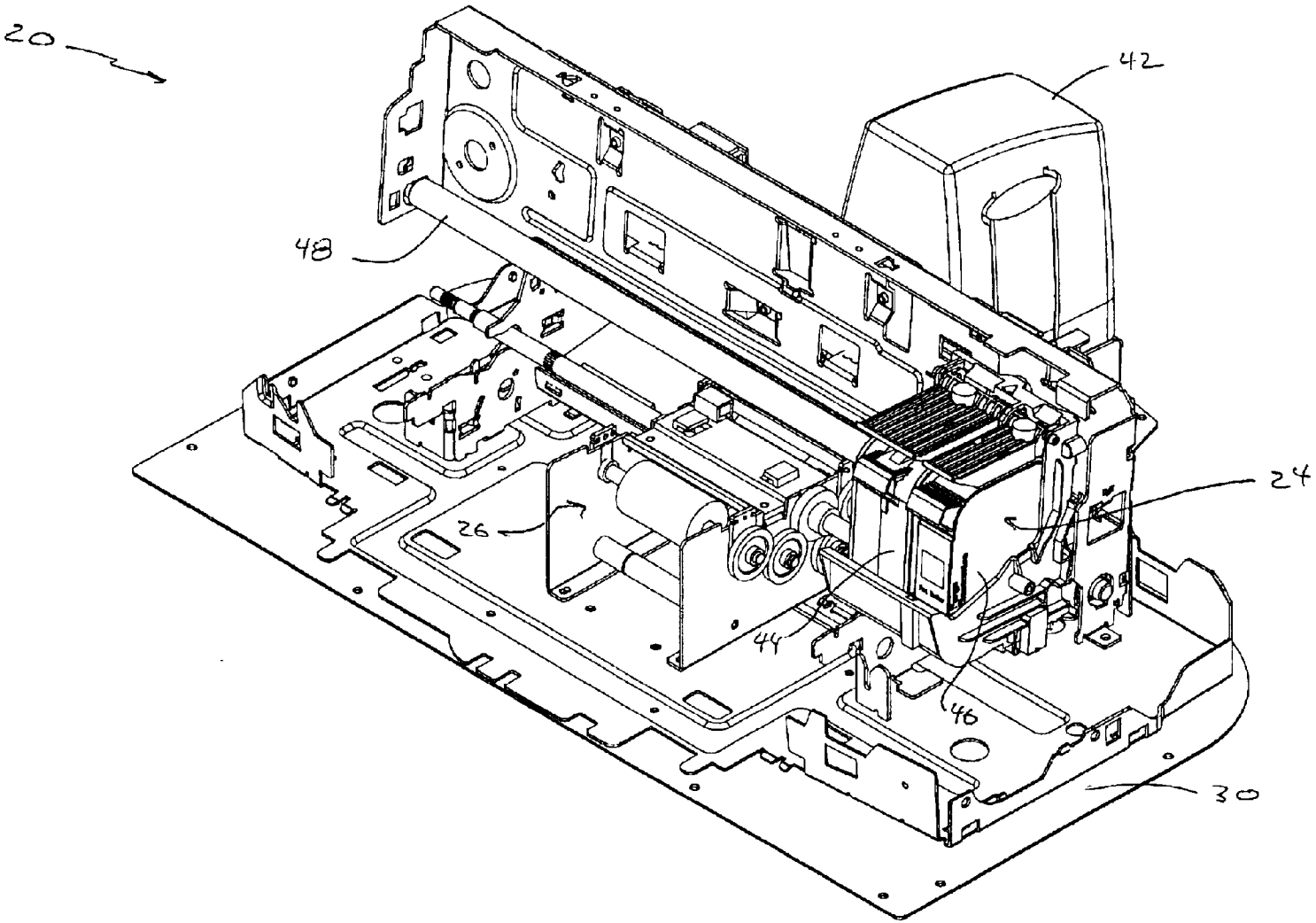
Figure 3:
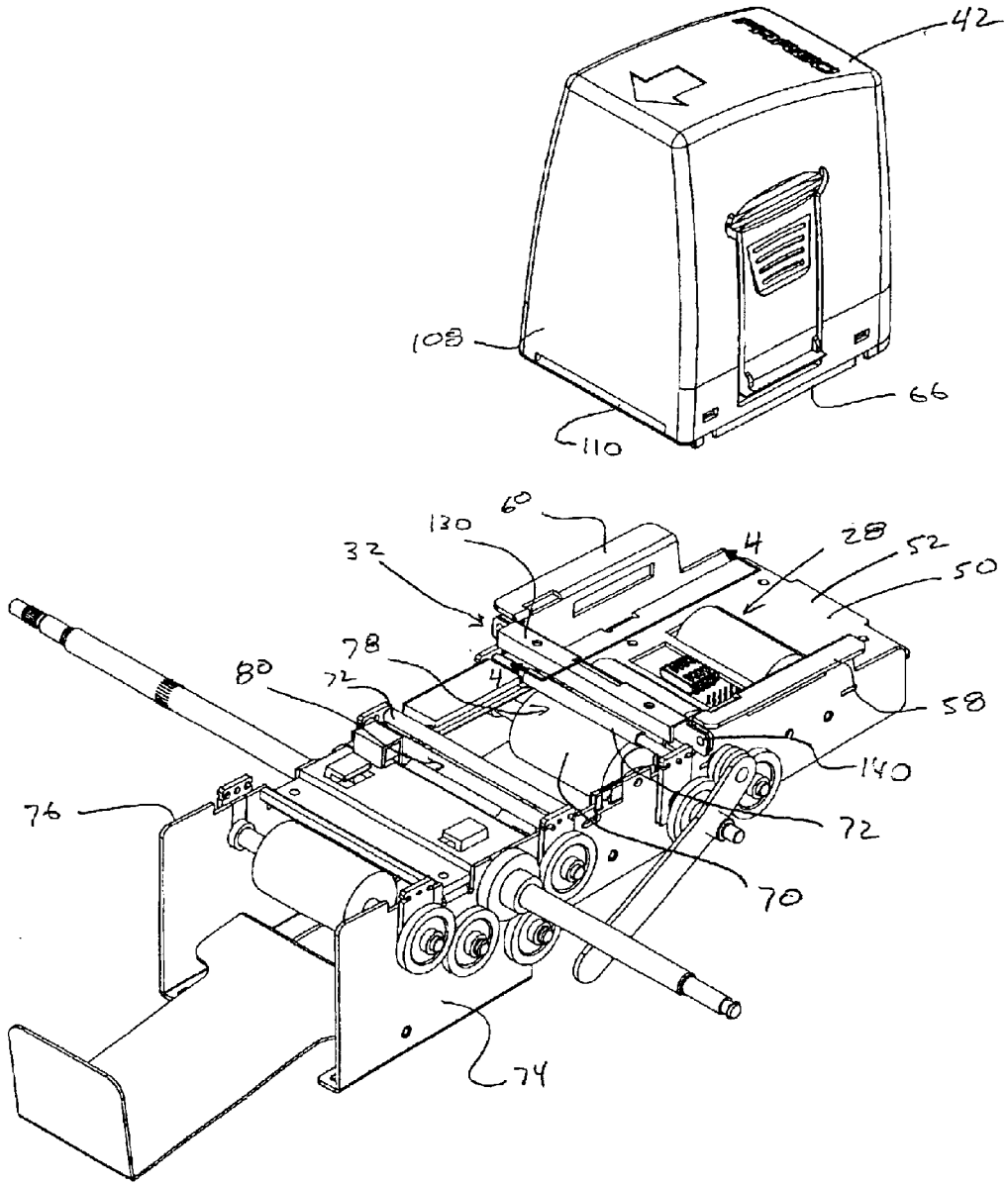
FIG. 3 is a perspective view of the card feeding components of the identification card printer of FIGS. 1 and 2 with a card cartridge lifted off a cartridge receiver, in accordance with embodiments of the invention.

FIGS. 1 and 2 are perspective views of an example of an identification card printer 20 respectively with and without a cover 22, in accordance with embodiments of the present invention. Printer 20 generally includes a print mechanism 24 and card feeding components including a card transport mechanism 26 and a card feeder 28, which are mounted to base 30 and are best shown in FIG. 3. Printer electronics (not shown) control the operation of the components of printer 20. As will be discussed in greater detail below, printer 20 also includes a card singularization gate 32 of the present invention, which singularizes the card feeding operations of printer 20 while avoiding potentially damaging abrasive contact with the card substrates.

Cover 22 of printer 20 includes front doors 34 and 36. Door 34 provides access to the components of printer 20 including print mechanism 24 and the card feeding components. Door 36 generally provides access to processed cards. Buttons 38 on cover 22 provide user input to printer 20 and turn printer 20 on and off. Printer 20 can also include lights 40 or a display on cover 22 to provide information to a user.

Card feeder 28 is generally adapted to drive a lead card from a card stack contained in card cartridge 42 through card singularization gate 32 to transport mechanism 26 during a card feed operation. Card singularization gate 32 prevents multiple card feeds where one or more cards stacked on the lead card are delivered to transport mechanism 26. Transport mechanism 26 receives the lead card from card singularization gate 32 and delivers the lead card to print mechanism 24 for printing.

Print mechanism 24 is depicted as an ink jet printhead having color and black ink jet cartridges 44 and 46, as shown in FIG. 2. Print mechanism 24 can also be a thermal printhead in combination with a thermal print ribbon, or other suitable print mechanism. Print mechanism 24 can also include a positioning mechanism for moving printhead 24 back and forth along rail 48 in a direction that is generally transverse to the card path along which transport mechanism 26 delivers the cards past print mechanism 24. Print mechanism 24 prints image lines on the cards to form the desired image as the card is moved along the print path by transport mechanism 26. Once the printing is complete, the printed card can be discharged into a card hopper or other card processing device by transport mechanism 26.

Figure 4:
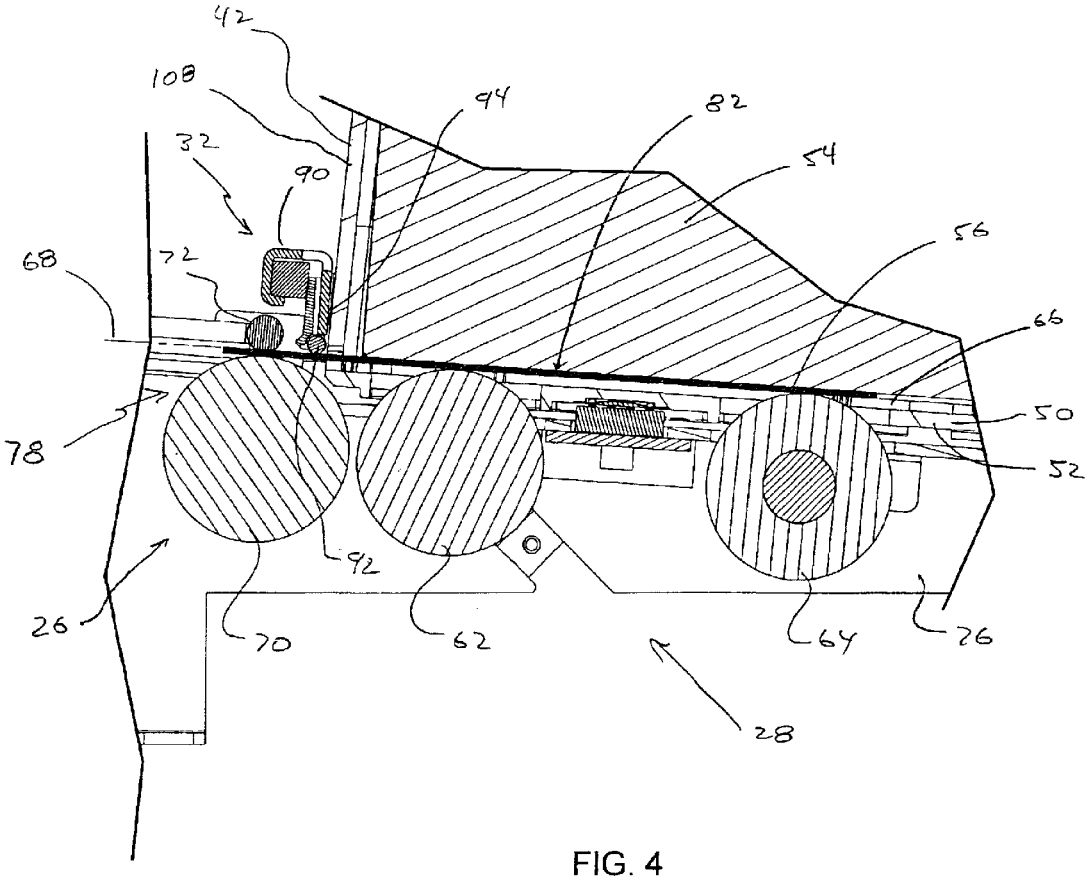
FIG. 4 is a cross-sectional view taken approximately along line 4—4 of a rear portion of the card feeding components shown in FIG. 3 with the card cartridge seated on a cartridge receiver, in accordance with embodiments of the invention.

With reference to FIGS. 3 and 4, a more detailed discussion of the card feeding components of printer 20 will be provided. FIG. 3 is a perspective view of card feeder 28, an embodiment of card singularization gate 32, and transport mechanism 26 with card cartridge 42 lifted off a cartridge receiver 50, to which it is mounted for operation with identification card printer 20. FIG. 4 is a cross-sectional view taken along line 4—4 of the rear portion of the card feeding components of FIG. 3 with card cartridge 42 seated on cartridge receiver 50.

Cartridge receiver 50 is adapted to receive cartridge 42 and generally includes a support member, such as deck 52 on which card cartridge 42 can be seated. Card cartridge 42 contains the card stack 54 having a lead card 56, as shown in FIG. 4. Card stack 54 could also be stored in a card hopper or other suitable container. Cartridge receiver 50 can also include guide members that assist in the proper installation of cartridge 42. For example, side walls 58 and 60 can operate as guide members by engaging cartridge 42 as it is seated on cartridge receiver 50. A cover (not shown) for cartridge receiver 50 can provide additional back and side guide members for further assistance in the proper installation of card cartridge 42.

Card feeder 28 preferably includes feed rollers 62 and 64, which are positioned adjacent cartridge receiver 50. At least one of the feed rollers 62 or 64 of card feeder 28 are driven by a motor (not shown) during a card feed operation to drive lead card 56 through card singularization gate 32 to transport mechanism 26. Portions of feed rollers 62 and 64 extend above deck 52 and through a card access of a base 66 of card cartridge 42 to engage the lead card 56 such that lead card 56 is lifted slightly off a base 66 and aligned with a card feed plane 68. Card feed plane 68 generally defines the card path along which lead card 56 will be initially fed. Card feeder 28 can take on other forms. For example, card feeder 28 could utilize a single feed roller or another suitable card feeding mechanism that is adapted to drive the lead card through card singularization gate 32 to transport mechanism 26.

Transport mechanism 26 includes a plurality of feed rollers 70 and guide rollers 72, some of which are driven by a motor (not shown). The feed and guide rollers 70 and 72 are mounted to side walls 74 and 76, which are mounted to base 30 of printer 20, as shown in FIG. 3. The feed and guide rollers 70 and 72 form pinch roller assemblies 78 and 80, which have either one or two guide rollers 72 mounted above a feed roller 70. The pinch and guide rollers 70 and 72 both have diameters that are significantly larger than the thickness of the cards in stack 54 including lead card 56. Additionally, feed rollers 70 preferably include a compressible rubber exterior layer that aides in the gripping and feeding of the card being processed. Such a configuration renders the pinch roller assemblies 78 and 80 susceptible to jamming in the event of a multiple card feed from card feeder 28 where one or more cards stick to a first surface 82 (FIG. 4) of lead card 56. One purpose of card singularization gate 32 of the present invention is to eliminate such multiple card feeds.

FIGS. 5–10 are simplified diagrams of card singularization gate 32 operating to singularize the feeding of cards by card feeder 28 in accordance with various embodiments of the invention. Card singularization gate 32 generally includes a roller support 90, a guide roller 92, and a card stop 94. Roller support 90 is positioned between card feeder 28 and card transport mechanism 26, as shown in FIGS. 3 and 4. Transport mechanism 26 and card feeder 28 are not depicted in FIGS. 5–10 in order to further simplify the illustrations. Guide roller 92 is supported by roller support 90 for rotation about axis 96 that is substantially parallel to card feed plane 68 and transverse to the card path. Guide roller 92 includes a card engaging side 98 that is positioned adjacent card feed plane 68 where non-abrasive rolling contact of a first surface 82 of lead card 56 is made during the card feed operation as lead card 56 is allowed passage to card transport mechanism 26. Card stop 94 is positioned adjacent a side 100 of guide roller 92 that is opposite the card engaging side 98. Card stop 94 blocks the passage of cards 102 stacked upon lead card 56 from passing to card transport mechanism 26 thereby preventing a multiple card feeds that could jam card transport mechanism 26.

Guide roller 92 is preferably positioned such that axis of rotation 96 is positioned slightly above card feed plane 68 such that lead card 56 is driven into card engaging side 98. Card feed plane 68 is generally defined by the top surface 82 of lead card 56 as it is fed by card feeder 28. Guide roller 92 is preferably sized substantially smaller than the feed and guide rollers 70 and 72 of pinch roller assemblies 78 and 80 of transport mechanism 26. More particularly, guide roller 92 preferably has a diameter that is less than three times a thickness of lead card 56. In accordance with one preferred embodiment, guide roller 92 has a diameter of approximately half the thickness of lead card 56. For example, guide roller 92 preferably has a diameter of approximately 0.060 inches where lead card 56 has a thickness of approximately 0.030 inches. The length of guide roller 92 can be shorter or longer than a width of lead card 56.

Figure 5:
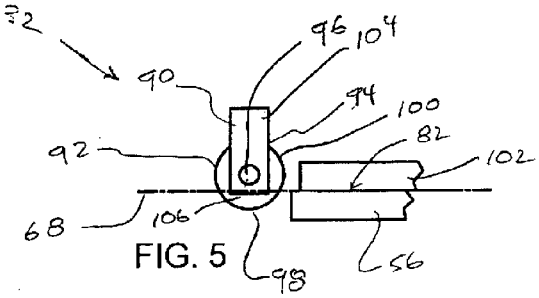
FIGS. 5–10 are simplified diagrams of card singularization gates in accordance with embodiments of the invention.

Roller support 90 and card stop 94 can take on many different forms. Roller support 90 generally includes a pair of side members 104, each of which supports and end 106 of guide roller 92, as shown in FIG. 5. Card stop 94 can be a component of roller support 90, such as side members 104 particularly when the length of guide roller 92 is less than a width of lead card 56, a plate extending between side members 104, side 100 of guide roller 92, or other card stopping component. Roller support 90 can be mounted to side walls 74 and 76 that operate as support structure for the card feeding components of printer 20, as shown in FIG. 3. Alternatively, roller support 90 can be mounted directly to housing 108 of card cartridge 42 adjacent output slot 110 through which cards are fed. The mounting of roller support 90 can be accomplished using any suitable fastening method. Alternative forms of roller support 90 can be used to provide the desired support of guide roller 92.

Figure 6:
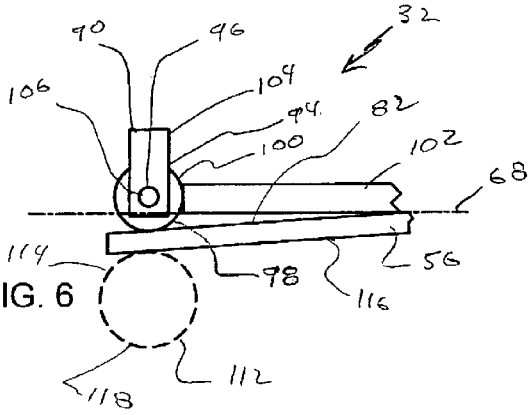

In accordance with the embodiment of card singularization gate 32 depicted in FIGS. 5 and 6, guide roller 92 is held in a fixed position relative to card feed plane 68 by roller support 90. During a card feed operation, card feeder 28 drives lead card 56 and at least one additional card 102 riding on top surface 82 of card 56 along card feed plane 68, as shown in FIG. 5. Guide roller 92 is positioned such that axis of rotation 96 is positioned slightly above card feed plane 68 such that lead card 56 is driven into card engaging side 98. As card feeder 28 continues to drive lead card 56 along card feed plane 68, guide roller 92 rotates in a clockwise direction for non-abrasive rolling contact with first surface 82 of lead card 56, as shown in FIG. 6. Lead card 56 is thus deflected downwardly away from card feed plane 68 and is allowed to pass to card transport mechanism 26 along card engaging side 98. Stacked card 102 is prevented from passing to card engaging side 98 of guide roller 92 due to the positioning of guide roller 92 relative to card feed plane 68 and the small diameter of guide roller 92. Thus, side 100 of guide roller 92 and side member 104 operate as card stop 94 to prevent stacked cards 102 from passing to card transport mechanism 26.

In accordance with another embodiment of the invention, card singularization gate 32 further includes a card support member 112 having a card engaging side 114 positioned adjacent the card feed plane 68 and facing the card engaging side 98 of guide roller 92, as shown in FIG. 6. Card support member 112 operates to engage a second surface 116 of lead card 56 to maintain lead card 56 in the desired position as it is fed past card singularization gate 32 to card transport mechanism 26. Card support member 112 is preferably a second guide roller 118 that is spaced from card engaging side 98 of guide roller 92 by a distance that is approximately that of the thickness of lead card 56. Alternatively, the distance separating card engaging side 98 of guide roller 92 and card engaging side 114 of second guide roller 118 can be slightly less than the thickness of lead card 56 when, for example, second guide roller 118 includes a compressible exterior layer.

In accordance with another embodiment of the invention, roller support 90 provides support to guide roller 92 such that it is moveable between first and second positions, as will be discussed with reference to FIGS. 7–10. In general, guide roller 92 is placed in close proximity to card feed plane 68 when in the first position, and displaced from the card feed plane 68 when in the second position. Guide roller 92, through support by roller support 90, is preferably moveable between the first and second positions either angularly and/or linearly. Card singularization gate 32 preferably includes a biasing member that is adapted to apply a force to direct the guide roller 92 toward the first position.

Figure 7:
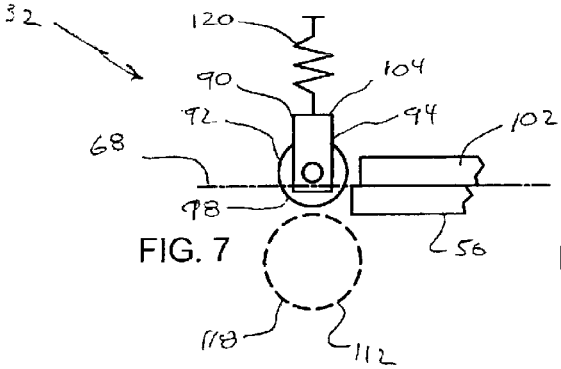
Figure 8:
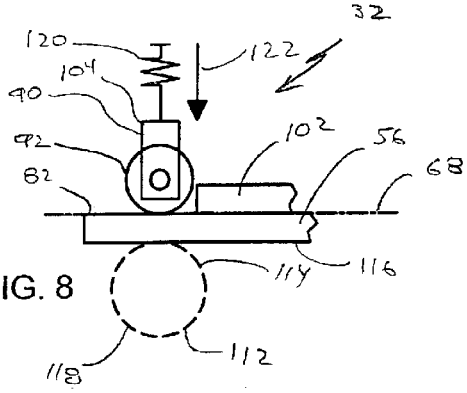

FIGS. 7 and 8 illustrate one embodiment of card singularization gate 32 in which guide roller 92 is allowed to move linearly relative to card feed plane 68 in a plane that is substantially perpendicular thereto. In FIG. 7, guide roller 92 is supported by roller support 90 in the first position adjacent card feed plane 68. Card engaging side 98 is positioned to engage lead card 56 as it is fed by card feeder 28 along card feed plane 68. As lead card 56 is driven into card engaging side 98 of guide roller 92, guide roller 92 moves to the second position along a plane that is substantially perpendicular to card feed plane 68, as shown in FIG. 8. When in the second position, guide roller 92 is displaced slightly from card feed plane 68 thereby allowing card engaging side 98 to roll over first surface 82 of lead card 56 and allow it to pass to card transport mechanism 26. Additionally, each side member 104 of roller support 90 can be allowed to move independently in the manner described relative to card feed plane 68.

As mentioned above, card singularization gate 32 preferably includes a biasing member, illustrated schematically at 120, which is adapted to apply a force represented by arrow 122 to direct guide roller 92 toward the first position. The force is generally applied to roller support 90. Thus, once lead card 56 is completely received by card transport mechanism 26, roller support 90 is directed by biasing member 120 back to the first position, shown in FIG. 7.

Figure 9:
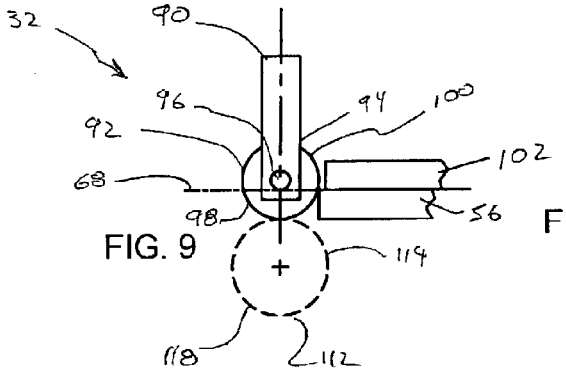
Figure 10:
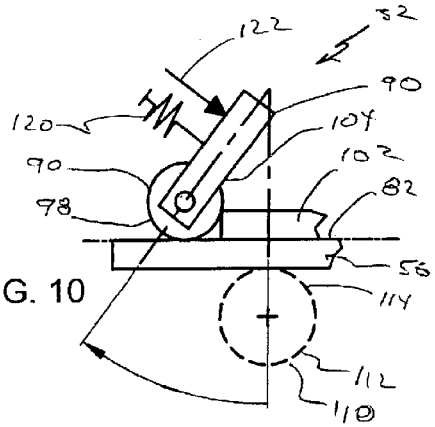

FIGS. 9 and 10 illustrate another embodiment of card singularization gate 32, in which guide roller 92 is allowed to move angularly or pivot between the first and second positions to accommodate the passage of lead card 56 to card transport mechanism 26. FIG. 9 illustrates the first position of guide roller 92, in which it is positioned for contact by lead card 56 as it is fed along card feed plane 68 by card feeder 28. Once contact with guide roller 92 is made, roller support 90 pivots to move guide roller 92 toward the second position, illustrated in FIG. 10, as lead card 56 continues along card feed plane 68. While in the second position, guide roller 92 rotates for non-abrasive engagement with first surface 82 of lead card 56 at side 98. Lead card 56 is thereby provided to card transport mechanism 26. This embodiment of card singularization gate 32 preferably includes a biasing member, illustrated schematically at 120, which is adapted to apply a force represented by arrow 122 to roller support 90 to direct guide roller 92 toward the first position, as shown in FIG. 10.

The embodiments of card singularization gate 32 depicted in FIGS. 7–10 can also include a card support member 112, illustrated in dashed lines, having a fixed position adjacent to card feed plane 68 to provide additional support to lead card 56 during card feeding operations as discussed above.

Figure 11:
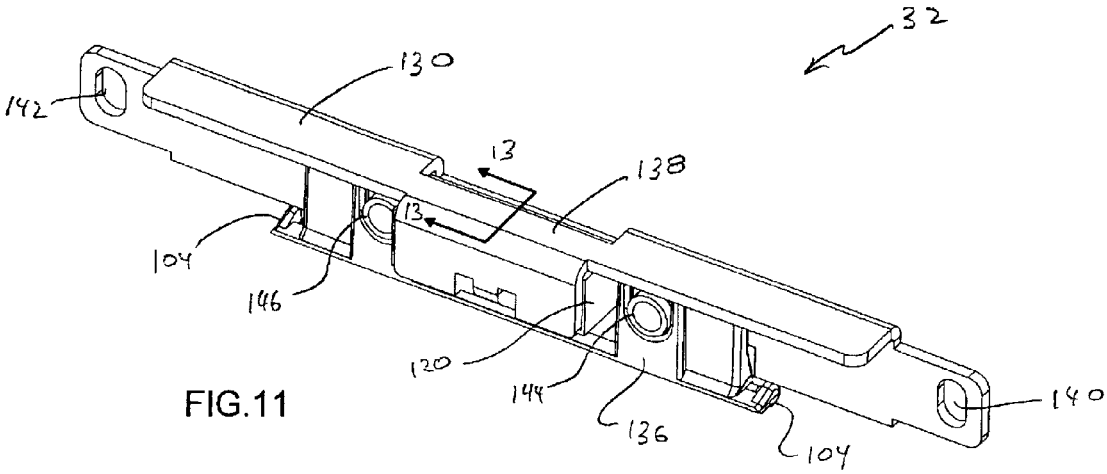
FIGS. 11–13 respectively show assembled and exploded perspective views, and a cross-sectional view of a card singularization gate in accordance with embodiments of the invention.
Figure 12:
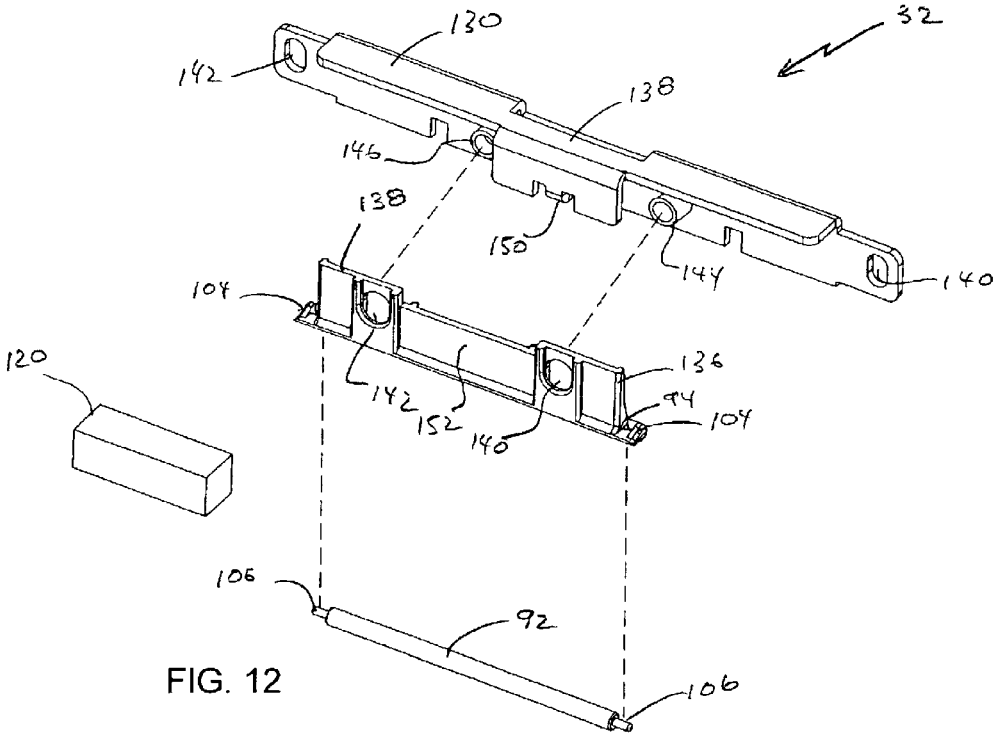
Figure 13:
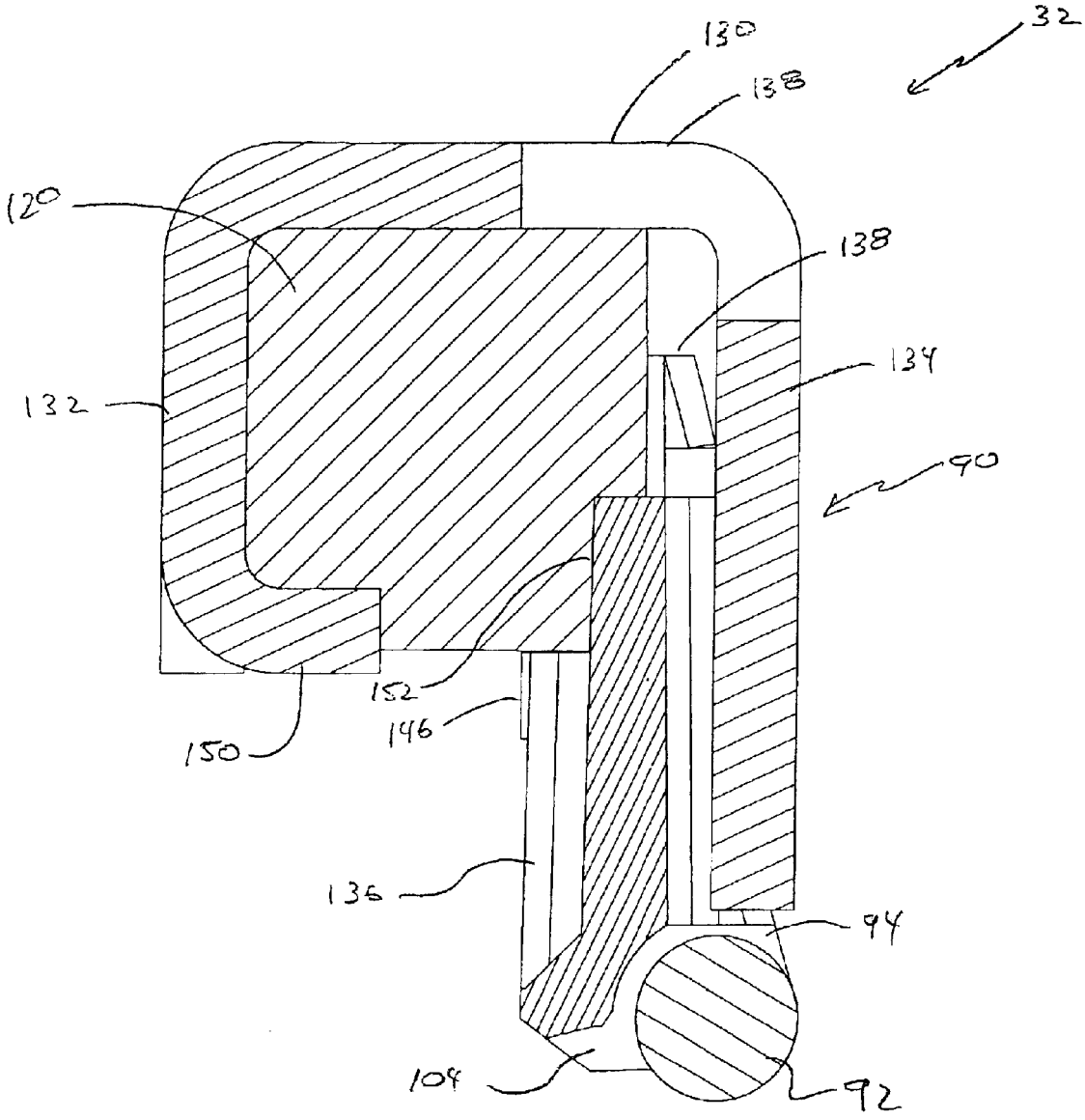

Referring now to FIGS. 11–13, a more detailed description of a card singularization gate 32 that is adapted to operate in the manner discussed with reference to FIGS. 9 and 10 above will be provided. FIGS. 11–13 respectively show assembled and exploded perspective views, and a cross-sectional view of a card singularization gate 32, in accordance with this embodiment of the invention. Here, roller support 90 includes a cross member 130 having front and rear opposing plates 132 and 134, and a hinge plate 136. Cross member 130 is preferably formed of a single piece of metal or plastic and includes a top member 138 connecting rear plate 134 to front plate 132. Cross member 130 is secured to suitable support structure of identification card printer 20, such as side walls 74 and 76 as shown in FIG. 3, or housing 108 of cartridge 42 using, for example, screws that are inserted through apertures 140 and 142 of rear plate 134, or by other suitable methods.

Hinge plate 136 is positioned between front and rear plates 132 and 134 and includes a top edge 138. Side members 104 are formed integral with hinge plate 136 and are adapted to provide the desired support of ends 106 of guide roller 92. Hinge plate 136 further includes apertures 140 and 142 that are respectively adapted to receive protrusions 144 and 146 that extend from rear plate 134 of cross member 130 and support hinge plate 136 and restrict horizontal and vertical movement of hinge plate 136 in a plane that is substantially parallel to rear plate 134. Card stop 94 is formed by hinge plate 136 and side members 104 of roller support 90.

Biasing member 120 is preferably a piece of compressible foam that is secured between front plate 132 and rear plate 134 as shown in FIGS. 11 and 13. Front plate 132 includes a hook 150 that secures biasing member 120 in position. Guide roller 92 can move in a substantially angular direction from the first position, shown in FIGS. 11 and 13, to the second position (FIG. 10) by pivoting hinge plate 136 about top edge 138 that engages rear plate 134. Hinge plate 136 is prevented from sliding horizontally and vertically due to protrusions 144 and 146. The pivoting of hinge plate 136 toward the second position compresses biasing member 120 between a rear side 152 of hinge plate 136 and front plate 132 thereby producing the desired force against hinge plate 136 that encourages its return to the first position as discussed above. It should be understood that biasing member can be a spring or other suitable component that is capable of generating the desired force that directs guide roller 92 back to the first position when displaced therefrom.

In operation, as lead card 56 is fed along card feed plane 68 by card feeder 28, lead card 56 engages guide roller 92 while in its first position, as depicted in FIGS. 9, 11 and 13. As lead card 56 continues along the card feed plane 68, hinge plate 136 pivots about top edge 138 against rear plate 134 of cross member 130 to move guide roller 92 to the second position, shown in FIG. 10. When in the second position, card engaging side 98 of guide roller 92 rolls over first surface 82 of lead card 56 as discussed above to allow passage of lead card 56 to card transport mechanism 26.

Although the present invention has been described with reference to preferred embodiments, workers skilled in the art will recognize that changes may be made in form and detail without departing from the spirit and scope of the invention.

What is claimed is:

1. A card singularization gate for use in an identification card printer to singularize card feed operations performed by a card feeder, in which a lead card of a card stack is driven along a card path defined by a card feed plane in a forward direction toward a card transport mechanism, which delivers the lead card to a print mechanism, the card singularization gate comprising:

a roller support positioned between the card feeder and the card transport mechanism, wherein an end of the roller support is movable in the forward direction;

a guide roller supported by the end of the roller support for rotation about an axis that is substantially parallel to the card feed plane and transverse to the card path, the guide roller having a card engaging side adjacent the card feed plane where non-abrasive contact of a first surface of the lead card is made during card feed operations; and a card stop adjacent a side of the guide roller that is opposite the card engaging side, whereby the lead card is allowed passage to the card transport mechanism along the card engaging side of the guide roller and cards that are stacked upon the lead card during the card feed operation are blocked by the card stop.

2. The system of claim 1, wherein the guide roller has a diameter of less than three times a thickness of the lead card.

3. The system of claim 1, wherein the roller support comprises a pair of side members adapted to form the card stop.

4. The system of claim 1, wherein the guide roller is movable between a first position, in which the guide roller is in close proximity to the card feed plane, and a second position, in which the guide roller is displaced from the card feed plane.

5. The system of claim 4, including a biasing member adapted to apply a force to direct the guide roller toward the first position.

6. The system of claim 5, wherein the biasing member is a spring or a compressible piece of foam.

7. The system of claim 5, wherein:

the roller support includes front and rear opposing plates and a hinge plate positioned between the front and rear plates and having a top edge; and the biasing member is positioned between the hinge plate and either the front or rear plates.

8. The system of claim 1, wherein the first surface of the lead card includes an ink receiving coating.

9. The system of claim 1 including a card support member having a card engaging side positioned adjacent the card feed plane and facing the card engaging side of the guide roller.

10. The system of claim 9, wherein the card support member is a second guide roller.

11. An identification card printing system comprising:

a card stack having a lead card;

a card feeder adjacent the card stack and configured to drive the lead card along a card path defined by a card feed plane during a card feed operation;

a removable card cartridge having a housing that contains the stack of cards, the housing having an output slot through which the cards are driven by the card feeder;

a card transport mechanism in line with the card path configured to receive the lead card during card feed operations and further transport the lead card to a print mechanism; and a card singularization gate comprising:

a roller support mounted to the card cartridge adjacent the output slot and positioned between the card feeder and the card transport mechanism;

a guide roller supported by the roller support for rotation about an axis that is substantially parallel to the card feed plane and transverse to the card path, the guide roller having a card engaging side adjacent the card feed plane where non-abrasive contact of a first surface of the lead card is made during card feed operations; and a card stop adjacent a side of the guide roller that is opposite the card engaging side, whereby the lead card is allowed passage to the card transport mechanism along the card engaging side of the guide roller and cards that are stacked upon the lead card during the card feed operation are blocked by the card stop.

12. The system of claim 11, wherein the guide roller has a diameter of less than three times a thickness of the lead card.

13. The system of claim 11, wherein the roller support includes a pair of side members each adapted to support an end of the guide roller.

14. The system of claim 13, wherein the side members of the roller support form the card stop.

15. The system of claim 11, wherein the guide roller is movable between a first position, in which the guide roller is in close proximity to the card feed plane, and a second position, in which the guide roller is displaced from the card feed plane.

16. The system of claim 15, including a biasing member adapted to apply a force to direct the guide roller toward the first position.

17. The system of claim 16, wherein the biasing member is a spring or a compressible piece of foam.

18. The system of claim 16, wherein:

the roller support includes front and rear opposing plates and a hinge plate positioned between the front and rear plates and having a top edge; and the biasing member is positioned between the hinge plate and either the front or rear plates.

19. The system of claim 11, wherein the first surface of the lead card includes an ink receiving coating.

20. The system of claim 11 including a card support member having a card engaging side positioned adjacent the card feed plane and facing the card engaging side of the guide roller.

21. The system of claim 20, wherein the card support member is a second guide roller.

22. The system of claim 11, wherein the guide roller is formed of metal or plastic.

23. A card singularization gate for use in an identification card printer to singularize card feed operations performed by a card feeder, in which a lead card of a card stack is driven along a card path defined by a card feed plane toward a card transport mechanism, which delivers the lead card to a print mechanism, the card singularization gate comprising:

a roller support positioned between the card feeder and the card transport mechanism;

a guide roller having a diameter less than three times a thickness of the lead card and supported by the roller support for rotation about an axis that is substantially parallel to the card feed plane and transverse to the card path, the guide roller having a card engaging side adjacent the card feed plane where non-abrasive contact of a first surface of the lead card is made during card feed operations; and a card stop adjacent a side of the guide roller that is opposite the card engaging side, whereby the lead card is allowed passage to the card transport mechanism along the card engaging side of the guide roller and cards that are stacked upon the lead card during the card feed operation are blocked by the card stop.

24. The system of claim 23, wherein the guide roller is movable between a first position, in which the guide roller is in close proximity to the card feed plane, and a second position, in which the guide roller is displaced from the card feed plane.

25. The system of claim 24, including a biasing member adapted to apply a force to direct the guide roller toward the first position.

* * * * *